United States Patent [19]

Violet

[11] 4,135,171

[45] Jan. 16, 1979

[54] CEMENT MIXER WITH SWITCH HARNESS

[75] Inventor: Jon A. Violet, Fredricktown, Ohio

[73] Assignee: The J. B. Foote Foundry Co., Fredericktown, Ohio

[21] Appl. No.: 802,737

[22] Filed: Jun. 2, 1977

[51] Int. Cl.[2] ..... B28C 5/18; H01H 9/02

[52] U.S. Cl. ..... 366/60; 200/51 R; 200/293; 310/68 A; 339/28

[58] Field of Search ..... 200/293, 51 R; 310/68 A, 71; 339/147 R, 147 P, 28; 259/177 R; 366/60, 57

[56] References Cited

U.S. PATENT DOCUMENTS

| | | | |
|---|---|---|---|
| 1,587,566 | 2/1926 | Tuthill | 310/68 A X |
| 1,722,816 | 7/1929 | Meunier | 339/147 P |
| 2,133,985 | 10/1938 | Green | 339/28 X |
| 2,531,350 | 11/1950 | Chrastina | 200/51 R |
| 2,907,855 | 10/1959 | Hedges | 200/51 R x |
| 2,944,799 | 7/1960 | Larson | 259/177 R |
| 3,054,994 | 9/1962 | Haram | 339/147 P X |
| 3,524,029 | 8/1970 | Laff | 200/51 R X |
| 3,761,862 | 9/1973 | Spiteri | 339/28 |
| 3,768,785 | 10/1973 | Susemihl | 336/60 X |
| 3,828,224 | 8/1974 | Hulshizer | 200/51 R X |

*Primary Examiner*—Daniel M. Yasich

*Attorney, Agent, or Firm*—Allen D. Gutchess, Jr.

[57] ABSTRACT

A switch harness is provided for a cement mixer. The cement mixer has a motor housing which encloses an electric motor and the drive components for the mixer drum. A switch harness is located in the housing and includes an on-off motor switch which is accessible outside of the housing. The harness also has a power cord extending outside the housing for connection with an extension cord. The switch harness has an electrical outlet within the housing for receiving the motor cord.

9 Claims, 5 Drawing Figures

CEMENT MIXER WITH SWITCH HARNESS

This invention relates to a switch harness for a cement mixer and specifically for an electric motor used to drive a drum of the cement mixer.

Particularly in a small, portable cement mixer, an electric motor used to drive the cement mixer drum is located within a housing, along with the drive and driven sheaves and V-belt or similar drive components. In many instances, the cement mixer is not sold with the electric motor, which presents a problem concerning subsequently enclosing the motor within the housing and yet providing a safe power connection and switch therefor.

In accordance with the invention, a switch harness is provided which includes a body having an on-off switch unit which is accessible from outside the housing and which mounts the body in the housing through a nut. The switch harness also includes a power cord which extends through the housing and is short enough to terminate well above the ground. This prevents the possibility of the cord being immersed in water or becoming contaminated with mud, for example. The power cord is connected to an extension cord and to a suitable source of power. In addition, the new switch harness has an electrical outlet built into the body and which receives directly the power cord from the motor, all contained within the housing. This arrangement enables the motor to be safely and quickly connected to a power source through the extension cord and the switch harness and also provides a safe on-off switch unit accessible outside the housing for operating the motor.

It is, therefore, a principal object of the invention to provide a switch harness for a motor and motor housing of a cement mixer.

Another object of the invention is to provide a switch harness for a motor housing, which harness has a switch unit accessible outside the housing, a power cord extending outside the housing, and a motor cord outlet within the housing.

Many other objects and advantages of the invention will be apparent from the following detailed description of a preferred embodiment thereof, reference being made to the accompanying drawings, in which.

Figure 1:
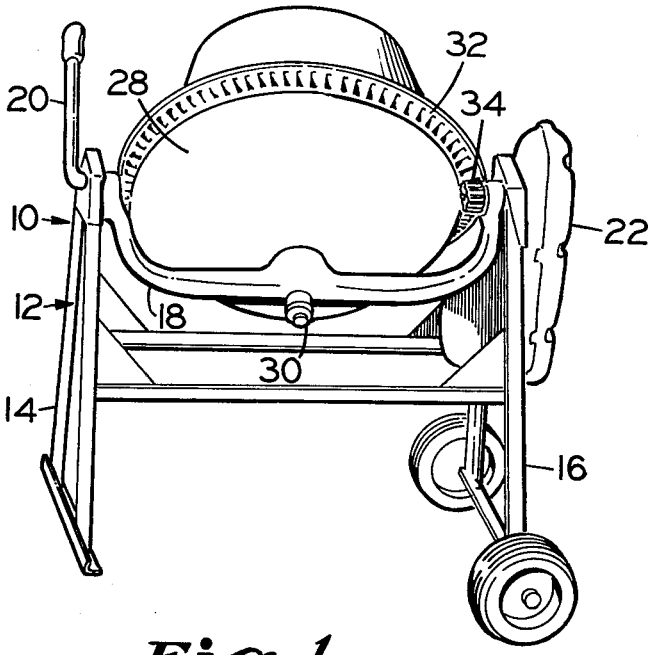
FIG. 1 is a somewhat schematic view in perspective of a cement mixer embodying the invention.
Figure 2:
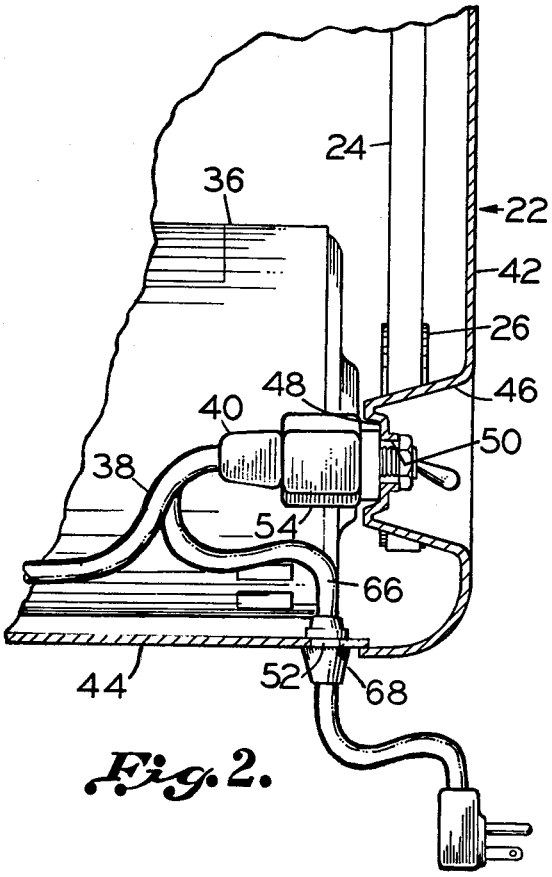
FIG. 2 is an enlarged, fragmentary view in section of a motor housing, motor, and switch harness according to the invention.

Referring particularly to FIG. 1, a small cement mixer as used by contractors and home owners is indicated at 10. Such mixers commonly have a capacity ranging from one-half to five cubic yards and are designed to be moved about, either by hand or by vehicle. The cement mixer 10 includes a main frame 12 having end frames 14 and 16 which pivotally support a drum yoke 18. At the end frame 14, the end yoke has a pivotal axle connected to an arm 20 which can be manipulated to pivot the yoke 18 about a horizontal axis extending through the end frames. At the end frame 16, the end of the yoke 18 is pivotally supported on a drive shaft which has a driven sheave (not shown) located within a motor housing 22. The sheave is engaged by a V-belt 24 (FIG. 2) which is driven by a drive sheave 26 in a lower portion of the housing 22.

A mixing drum 28 is rotatably mounted on an intermediate, horizontal portion of the yoke 18 by means of a bearing and axle assembly 30. A circular ring gear 32 is circumjacent an intermediate portion of the mixing drum 28 and is affixed thereto, as by welds. A ring gear 32 meshes with a pinion gear 34 mounted on the drive shaft and rotates the ring gear and the drum when driven.

An electric motor 36 with a power cord 38 and a male plug 40 are located in the housing 22, which includes an outer housing part 42 and an inner housing part 44 in which the motor 36 is mounted. The outer housing part 42 has a deep recess 46 therein forming a shallow counter recess 48 and an opening 50. The inner housing part 44 has a notch 52 therein along the edge which mates with the outer housing part 42.

In accordance with the invention, a switch harness 54 is located within the housing 22 to provide an electrical connection for the electric motor 36. The switch harness 54 includes a main body 56 which encloses certain electrical components, the body preferably being injection molded and of polyvinyl chloride. The one end of the body has a female outlet indicated at 58 including two prong recesses 60 and 62 and a ground prong recess 64 to receive the plug 40 of the power cord 38 of the electric motor 36.

Figure 3:
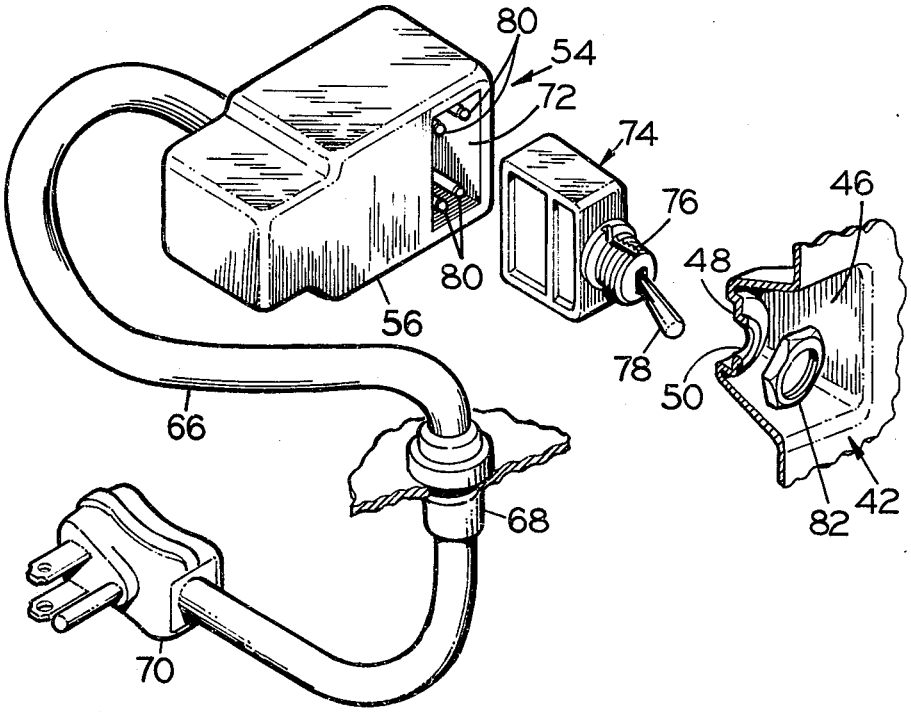
FIG. 3 is an exploded view in perspective of the components of FIG. 2.
Figure 4:
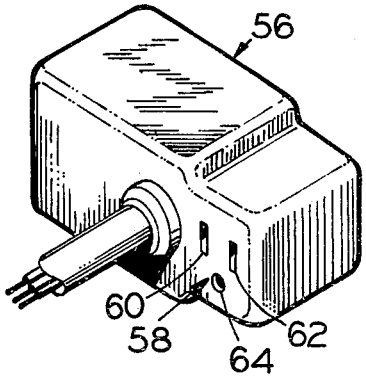
FIG. 4 is a rear view in perspective of the switch harness body.

Power for the motor 36, in turn, is supplied through a power cord 66 having a molded enlargement 68 thereon received in the notch 52 (FIGS. 1 and 3) of the inner housing part 44. The cord extends below the housing 22 to a male plug 70 which can be connected to an extension cord for power. The cord 66 is of a length to extend only a short distance below the motor housing 22 to avoid the possibility of the plug 70 contacting the ground and shorting out in water or being contaminated.

At the other end of the main body 56, on the side opposite the female outlet 58, a recess 72 is formed. The recess 72 receives a switch unit 74 which is a commercially-available item and has a forwardly-extending threaded neck 76 and an outwardly-extending switch handle 78. The unit 74 is electrically connected with the body 56 through four prongs 80 in the recess 72. The threaded neck 76 of the switch unit 74 extends through the opening 50 in the outer housing recess 46 and receives a hex nut 82 which holds the switch unit 74 and the main body 56 in place at the rear of the outer housing half 42. More specifically, the front face of the switch unit 74 is received in the shallow recess 48 to maintain it in position by means of only the single hex nut 82.

Figure 5:
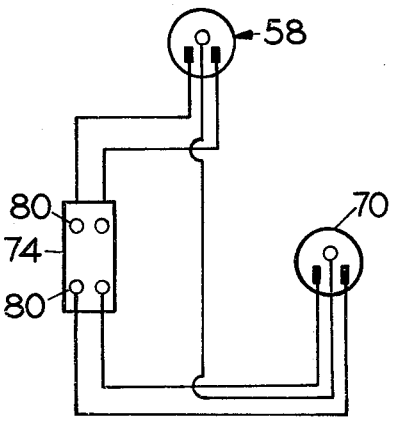
FIG. 5 is a diagrammatic view of the circuit embodied in the switch harness.

As shown in FIG. 5, the switch 74 connects the male plug 70 and the female outlet 58 to supply power to the motor 36 and also disconnects the plug and outlet when the switch 74 is turned off. The switch handle 78 is located substantially completely within the deep recess 46 in the outer housing part 42 so as not to be subjected to accidental physical damage.

With the switch harness 54 according to the invention, the motor can be simply plugged into the female outlet 58 and the male plug 70 plugged into the extension cord. When it is desired to operate the mixer, the switch handle 78 can be manipulated to turn on the switch unit 74 and supply the power. Hence, the motor 36 can be rapidly assembled and electrically connected in the motor housing 22 to ready the cement mixer for operation. The switch handle 78 also is always readily accessible to operate the mixer without the need for opening or closing any covers.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. In combination, a cement mixer having a mixing drum, a housing mounted on a supporting frame of said cement mixer, an electric motor within said housing for driving said mixing drum, said motor having a cord and male plug, a switch harness in said housing, said switch harness including a main body of cast material having a female outlet molded therein for receiving the motor plug, said main body also having a recess molded therein, a switch unit received in said body recess, said switch unit having a switch with terminals electrically connected with said outlet through conductors molded into said body, said switch unit having a handle extending outside said housing to enable an operator to turn on and shut off said switch from outside said housing, and a second cord and a second plug extending from said body out of said housing and electrically connected with terminals of said switch through other conductors molded into said body.

2. The combination according to claim 1 characterized by said second cord being sufficiently short to suspend said second plug above the surface on which the cement mixer rests.

3. The combination according to claim 1 characterized by said body having said switch unit recess on the side thereof opposite the side having said outlet.

4. The combination according to claim 3 characterized by said switch unit having a threaded neck extending through an opening in said housing, and a nut turned on said neck to hold said switch unit in a fixed position relative to said housing.

5. A switch harness for electrically connecting a motor within a housing to a source of power outside the housing, said switch harness being within the housing and comprising a main body of cast plastic material having a female outlet molded into one end portion thereof for receiving a male plug of the motor, a power cord extending from said body and electrically connected with a switch of a switch unit, a male plug connected to said power cord, said body having a main recess therein spaced from said outlet and having electrical connections therein connected electrically with said female outlet and said power cord, and the switch unit being received in said recess and electrically connected with the electrical connections therein, said switch unit having a threaded neck thereon and a handle extending from said neck.

6. A switch harness according to claim 5 characterized by said switch unit recess being on the side of said body opposite the side having said female outlet.

7. In combination, a frame supported on the ground, a housing carried by said frame, an electric motor within said housing, said motor having a cord and a male plug, a switch harness in said housing, said switch harness including a switch unit, a main body having a female outlet on one side thereof for receiving the motor plug, said main body also having a recess on one side to removably receive said switch unit, said switch unit having a switch with terminals electrically connected to said outlet, said switch unit having a handle extending outside said housing to enable an operator to turn on and shut off said switch from outside said housing, said switch unit having a threaded neck extending through an opening in said housing and a nut turned on said neck to hold said switch unit and said body in a fixed position relative to said housing, and a second cord and a second male plug extending from said body out of said housing and electrically connected with said switch terminals, said second cord being sufficiently short to suspend said second plug above the ground away from dirt and water, said switch handle being on a side of said main body other than that containing the female outlet.

8. The combination according to claim 7 characterized by said main body having a recess therein spaced from said female outlet, and a switch unit having said switch received in said body recess.

9. The combination according to claim 8 characterized by said body having said switch unit recess on the side thereof opposite the side having said outlet.

* * * * *